United States Patent [19]

Markowitz et al.

[11] 4,357,851

[45] Nov. 9, 1982

[54] METHOD AND APPARATUS FOR PRODUCING MIXTURE TONES IN AN ELECTRONIC MUSICAL INSTRUMENT

[75] Inventors: Jerome Markowitz, Allentown; Thomas M. Schenck, Pottsville, both of Pa.

[73] Assignee: Allen Organ Company, Macungie, Pa.

[21] Appl. No.: 242,754

[22] Filed: Mar. 11, 1981

[51] Int. Cl.[3] ..... G10H 1/08; G10H 1/18; G10H 7/00

[52] U.S. Cl. ..... 84/1.01; 84/1.19; 84/1.23

[58] Field of Search ..... 84/1.01, 1.03, 1.11–1.13, 84/1.19–1.26

[56] References Cited

U.S. PATENT DOCUMENTS 3,610,799 10/1971 Watson ..... 84/1.01

*Primary Examiner*—Stanley J. Witkowski

*Attorney, Agent, or Firm*—Seidel, Gonda, Goldhammer & Panitch

[57] ABSTRACT

A digital electronic organ mixture system comprises a pair of digital organs operatively connected in parallel to the same keyboard or keyboards. The keys are grouped into regions of adjacent keys. In one of the parallel organ systems, the frequency numbers ascend along the keyboard corresponding to the notes associated with the keys. In the other parallel organ system, the frequency numbers are weighted by preselected factors, the factor being the same for each keyboard region, and the factor for each successive region along the keyboard being lower than the factor for the immediately preceding region. Activation of a key along the keyboard produces a pitch series comprising a note produced by the unweighted frequency numbers in one organ system and a second note produced by the weighted frequency numbers in the other organ system. The pitch series breaks back at each successive keyboard region in accordance with the weighting factor for that region. One or more additional complex wave forms may be stored in the organ system having weighted frequency numbers, to produce other tones in the pitch series.

24 Claims, 3 Drawing Figures

METHOD AND APPARATUS FOR PRODUCING MIXTURE TONES IN AN ELECTRONIC MUSICAL INSTRUMENT

BACKGROUND OF THE INVENTION

The invention is directed to a digital electronic system for producing mixture tones simulative of mixture tones produced in a pipe organ.

In a pipe organ, the term "mixture" refers to a particular type of compound stop. A compound stop, when drawn, allows each pipe organ key to simultaneously play what may be considered a chord of notes consisting of a note plus one or more additional notes higher in the scale. The relationship between the notes in the chord remains constant, creating a pitch series. A mixture is a particular type of compound stop in which the pitch series relationship between the notes is maintained only over discrete sections of the keyboard, and the relationships "break back" in pitch separation one or more times along the keyboard as the musical scale ascends.

The breaks keep the pitch relationship such that a lively timbre is maintained in the produced notes over the entire scale. Without the breaks, the notes at the high end of the keyboard would be compounded with chord notes approaching or exceeding the maximum audible range of the human ear. As frequencies approach the upper limit of the audible range, they sound progressively weaker and eventually become sub-audible. The result is that the warm mixture effect is lost. By breaking back to a lower frequency series relationship as the scale ascends, a good mixture effect can be maintained.

There are a wide variety of recognized and named mixtures in the pipe organ art. Moreover, an organ maker is free to create his own unique mixtures. Selecting a typical mixture, the three rank Fourniture as an example, the correspondence between keyboard regions and the pitches of the desired tones in the mixture as played on a pipe organ are indicated in Table 1 below:

TABLE 1

| Keyboard Region | Rank I | Rank II | Rank III | Note Pattern |
|---|---|---|---|---|
| CC to BB (Base) | 22** | 26 | 29 | CGC |
| C to B (Tenor) | 19 | 22 | 26 | GCG |
| $C^1$* to $B^1$ (Middle) | 15 | 19 | 22 | CGC |
| $C^2$ to $B^2$ (Treble) | 12 | 15 | 19 | GCG |
| $C^3$ to $C^4$ (High) | 8 | 12 | 15 | CGC |

*Middle C
**Stop-pitch number

The compound stop for the three rank Fourniture mixture outlined above sounds a specific pattern of notes. Within any of the five keyboard regions, a depressed key will sound selected notes which are a specific number of harmonics above that depressed key. For example, the middle C key sounds the number 15, 19 and 22 stop pitches (fourth, sixth and eighth harmonic series) to produce a C3G3C4 mixture note pattern. The number series of the harmonics which are sounded by the three rank Fourniture mixture for each keyboard region are set forth in Table 2 below:

TABLE 2

| Keyboard Region | Rank I | Rank II | Rank III |
|---|---|---|---|
| Bass | eighth | twelfth | sixteenth |
| Tenor | sixth | eighth | twelfth |
| Middle | fourth | sixth | eighth |
| Treble | third | fourth | sixth |
| High | second | third | fourth |

In the electronic organ field, various schemes have been proposed for the production of mixtures. One scheme involves substituting, for each organ pipe, an electronic tone source of equivalent pitch and intensity. This approach is straightforward but is relatively expensive and does not lend itself towards the economies of variety which should be provided by an electronic organ.

Another scheme that has been proposed is to "unify" or borrow pitches through various wiring arrangements. In such a scheme, a single electronic tone source may be employed by a plurality of keys on the keyboard. In this scheme, however, "missing notes" may appear when contrapuntal music is played, thereby damaging the continuum of the music.

A further method of producing mixture is possible in a digital electronic organ of the type wherein sample points of complex wave forms are stored as binary numbers in a memory and are read out at the note frequencies. A digital organ of this type is shown in U.S. Pat. Nos. 3,515,792 and 3,610,799. This further method entails programming into the voice memory a complex wave form which is a composite wave form made up of a voice and certain mixture series related harmonics of the voice in order to simulate the desired composite mixture tone. Breaks can be produced by using different composite complex wave forms for different ascending portions of the keyboard. However, by this approach the higher harmonic content of the composite mixture wave forms require a substantial increase in the number of sample points necessary to represent those wave forms, with a concommitant increase in the memory size necessary to accommodate the increased data. Also, the memory must have a different composite wave form for each keyboard region.

Also, in the solution suggested in the immediately preceding paragraph the composite complex wave form is read out of memory at the fundamental note frequency which corresponds to an active key. Thus, the harmonic content of a mixture is present in the composite complex wave form but all harmonics are read out of memory at the rate of the fundamental note frequency. The result is an unnatural slowness of speech or attack for the higher harmonic components of the mixture, rather than the expected brillance associated with a true mixture. This results because the human ear expects a fast attack with a high pitched note or notes. Because the mixture wave form is read out of memory at the single frequency associated with the depressed key, the listener discerns the mixture to be slower in attack than normally expected.

Accordingly, it is an object of the present invention to provide a mixture system in a digital electronic organ or any other similar digital electronic musical instrument in which a mixture pattern having proper speech results. It is a further object to accomplish the above without increasing memory size to accommodate many sample points.

BRIEF SUMMARY OF THE INVENTION

In a keyboard electronic musical instrument of the type wherein musical tones are produced by reading out of memory stored sample points of a complex wave form, the sample points being read out of memory at a rate corresponding to a frequency number associated with a key of the keyboard, a method of producing a mixture tone comprises the steps of (a) providing a keyboard having a selected number of keyboard regions corresponding to the number of "breaks" desired in the mixture; (b) weighting the frequency numbers associated with the respective keys by a preselected factor for each keyboard region, the factor for each successive region along the keyboard (proceeding from the lower end of the musical scale to the upper end) being lower than the multiple for the immediately preceding region; (c) storing in memory a complex wave form which is a composite of two or more selected wave forms; and (d) reading out of memory said stored wave form at a rate corresponding to the weighted frequency numbers associated with an active key.

In a preferred embodiment, a digital electronic organ mixture system comprises a pair of digital electronic organ systems connected to the same keyboard or keyboards so that they operate simultaneously and in parallel. Each organ system is the type wherein sample points of a complex wave form are stored in a memory, and tones are provided by reading the sample points out of memory at a rate corresponding to frequency numbers associated with an active key. In each system, frequency numbers are stored in frequency number memories which are selectively addressed in response to the depression of the keyboard keys, and each selected frequency number is repeatedly added to itself at a fixed rate to produce an address signal for reading the sample points of the complex wave form out of memory at the desired rate. The parallel musical systems differ from each other. In the basic organ system, which is a conventional digital electronic organ system, the stored frequency numbers ascend along the keyboard and a complex wave form representing a voice or voices is stored and read out of memory at a rate corresponding to the frequency number associated with an active key. In the mixture organ system, the stored frequency numbers are preselected multiples of the frequency numbers in the basic organ system, the multiple being the same within a keyboard region, and the multiple for each successive keyboard region being lower than the multiple for the immediately preceding region. One or more mixture voices are stored and read out of memory at the frequency corresponding to the weighted frequency number associated with the active key. The "break backs" in the mixture tone are created by changing the frequency number weighting multiple for discrete regions of the keyboard as the musical scale ascends.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figures 1, 2A:
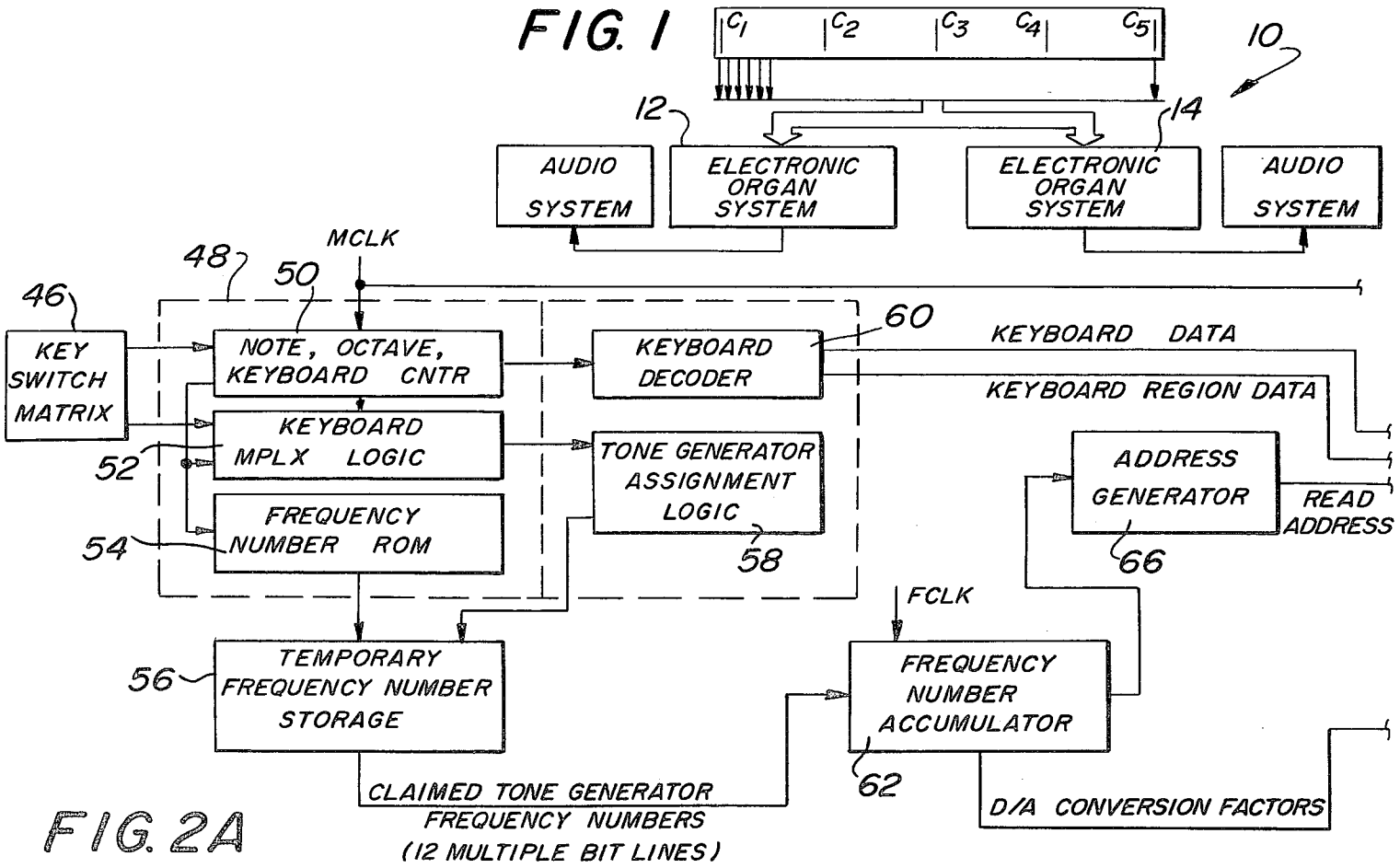
FIG. 1 is a conceptual representation of the invention employing parallel connected digital electronic organs.
FIGS. 2A and 2B comprise a block diagram of the mixture organ system in FIG. 1.

Referring to the drawings in detail, wherein like numerals indicate like elements, there is shown in FIG. 1 a preferred embodiment of the mixture system of the present invention designated generally as 10. The mixture system 10 includes similar digital electronic organ systems 12, 14 connected in parallel to the keys of a common keyboard 16. By parallel is meant that the systems 12, 14 may be simultaneously actuated in response to the same key depressions. Each digital organ system 12, 14 is of the type described in U.S. Pat. No. 3,610,799 issued Oct. 5, 1971 to George A. Watson. Such a digital organ system is also described in U.S. Pat. No. 3,639,913 issued Feb. 1, 1972 to George A. Watson. These patents describe specific conventional details of the structure and operation of the digital electronic organ systems 12 and 14 and are incorporated herein by reference.

Organ system 12 may be thought of as the basic organ system. As such, it operates in the manner described in the above patents. Organ system 14 may be thought of as the "mixture" organ system. Organ system 14 operates generally in the manner described in the above patents with differences described more fully hereafter. A difference between organ systems 12 and 14 lies in their voice memories, particularly in the complex wave forms stored in the memories, and in the frequency numbers programmed into their respective frequency number memories. This will become clear upon reading the more detailed description of each organ system which follows.

Figure 2B:
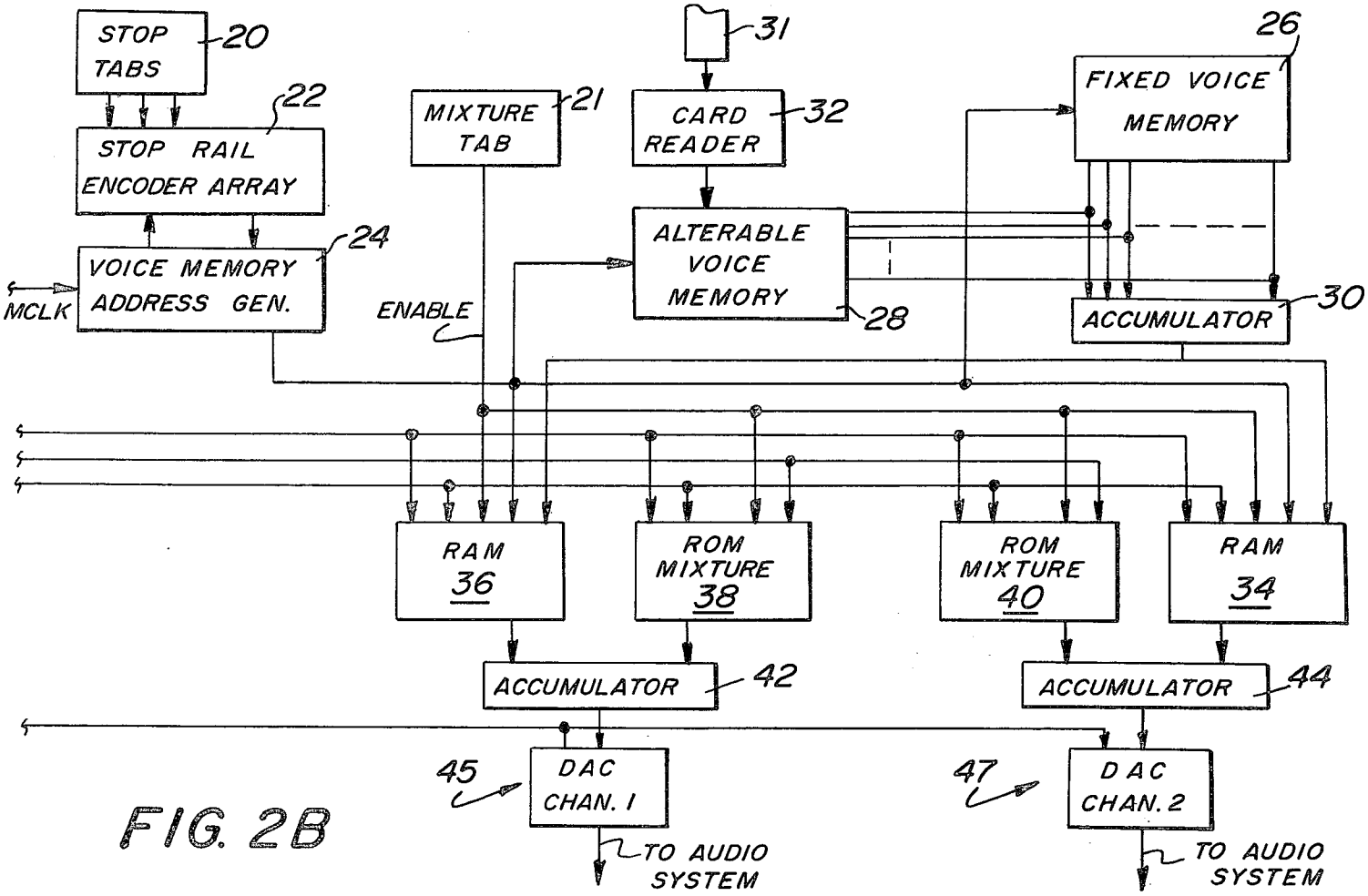

For ease of explanation, reference is made to FIGS. 2A and 2B which comprise a block diagram of the "mixture" organ system 14. Portions of organ systems 12 and 14 are identical, with organ system 14 having additional features, so that organ 12 can also be easily described by reference to FIGS. 2A and 2B.

Before describing in detail the mixture organ system 14 shown in FIGS. 2A and 2B, it is helpful to summarize the digital organ systems disclosed in U.S. Pat. Nos. 3,610,799 and 3,639,913. Operation of these digital organ systems is based on the principle that any periodic wave form can be reconstructed by sampling the amplitude of the wave form at a number of discrete regularly spaced intervals. This basic concept is disclosed in U.S. Pat. No. 3,515,792 wherein the sample points of the wave form are stored in memory and read out at a selectively controlled rate. The highest harmonic component which can be accurately reproduced in the wave form is proportional to the number of sample points in the wave form. The greater the number of sample points, the higher the harmonic content capable of being accurately produced. The harmonic structure of a sound or tone, therefore, is determined in the first instance by the array of binary numbers representative of sample points of the wave form. The tone is also identified by its frequency, or pitch. The frequency or pitch is governed by the rate at which the stored sample points are read from the memory. The information read from the memory is applied to a digital-to-analog converter, amplified, and fed to audio speakers for sound production.

Referring now to FIGS. 2A and 2B, a set of stop tabs 20 is provided to allow the organist to select the complex wave forms or "voices" in which the organ will be played. Actuation of one or more stop tabs is detected by a stop rail encoder 22 and encoded into a time division multiplexed signal containing information identifying the activated tabs. Multiplexing of the stop tabs is well known and is disclosed for example in U.S. Pat. No. 3,610,799 at column 20, line 24 et seq. The multiplexed signal is processed by a voice memory address generator 24 which decodes the stop tab activity information and develops address signals to address the selected complex wave forms or voices from the voice memories 26 or 28.

In the embodiment shown in FIGS. 2A and 2B, there are two voice memories which may be used alternatively, a voice memory ROM 26 containing certain fixed voices, and an alterable memory 28. Alterable memory 28 can be programmed with sample point data corresponding to a variety of wave forms or voices on punched cards 31 by means of a card reader 32.

The wave forms selected by the stop tabs from voice memory 26 or voice memory 28 are compiled by an accumulator 30. Accumulator 30 combines the respective sample points of the selected wave forms to produce the sample points of a composite wave form. This composite wave form represents the voice in which the basic organ system 12 will be played. As described more fully below in connection with the preferred embodiment, the mixture organ system 14 generates and uses a similar composite wave form, which may be identical to the wave form generated in system 12, along with other stored wave forms to produce an enhanced mixture sound.

The composite wave form from accumulator 30 is written into one or both of RAMs 34 and 36, in response to commands from the address generator 24. In the preferred embodiment, RAMs 34 and 36 are found in the basic organ system 12 as well as the mixture organ system 14 although the mixture organ system 14 has additional memories not found in the basic organ system 12, specifically ROMs 38 and 40, which store the mixture wave forms described hereafter. In the course of manufacture, however, it may be less costly to provide ROMs 38 and 40 in the basic organ system 12 without programming any wave form into them, or using them for other purposes. This is the same effect as if ROMs 38 and 40 were not present. All other elements of the basic organ system 12 and mixture organ system 14 are the same with the exception of the content of the frequency number memories of the systems and the mixture tab 21 described hereafter.

Memories 34, 36, 38 and 40 may be referred to collectively as voice "registration" memories. In response to address and read command signals, the addressed sample points stored in the registration memories 34, 36, 38 and 40 are read out into accumulators 42 or 44. Accumulator 42 receives the addressed sample points from memories 36 and 38. These sample points are combined in accumulator 42 to produce tones in a first audio channel 45. The resultant binary number from accumulator 42 is sent to a digital-to-analog converter to be converted into an analog signal for an audio speaker. The details of this further processing are well known to those skilled in the art and need not be further discussed. Similarly, for simplicity, there has been omitted any discussion of other processing which is normally performed on the digital signals, such as attack and decay, scaling and interpolation. These further processes are well known and do not constitute any part of the present invention. In a similar manner, the sample points read out of memories 34 and 40 are combined by accumulator 44 and after further processing are converted to analog signals for a second audio channel 47.

The keys on one or more keyboards of the organ are scanned by a keyboard encoder 48 via a key switch matrix 46. Keyboard encoder 48 repetitiously scans the keys of the organ in sequence, at a frequency determined by a master system clock (MCLK). The keyboard encoder 48 includes a counter 50 which produces count signals indicating the note, octave and keyboard being scanned. Encoder 48 also includes keyboard multiplexed logic 52 which encodes the identification of active keys into the time slots of a time division multiplexed signal ("multiplexed key information"). These functions of encoder 48 are well known and are described in detail in U.S. Pat. No. 3,610,799.

Encoder 48 also includes a frequency number ROM 54 in which are stored frequency numbers, which are binary numbers, each of which correspond to the frequency of a note on the keyboard scale. The frequency numbers increase as the keyboard scale ascends. In the preferred embodiment, these frequency numbers are stored in memory and are selectively addressed according to the key or keys depressed. Alternatively, frequency numbers could be calculated based on keyboard activity by a frequency number generator as described in U.S. Pat. No. 3,639,913.

The frequency numbers are transferred to temporary frequency number storage 56 which may comprise a bank of shift registers. In a preferred embodiment of the invention, there are 12 tone generating systems. Thus, the frequency numbers are stored in 12 multiple bit register positions and are read out at appropriate times on 12 parallel multiple bit lines, each multiple bit line going to a separate tone generating system, as is well known in the art.

The selection of one of the 12 tone generating systems to accept the frequency number for an active key depends on the availability of the tone generating system, that is, whether the system is already producing a note. This assignment of tone generators is controlled by tone generator assignment logic 58. Assignment logic 58 decodes the information of the multiplexed keyboard signal to determine which keys have been depressed. When assignment logic 58 determines which generator to assign for production of the note, it sends a signal to temporary frequency number storage 56, which gates out the frequency number corresponding to the active key onto the specific one of the 12 multiple bit lines connected to the newly assigned tone generator. This assignment of tone generators is disclosed in detail in U.S. Pat. No. 3,610,799.

For simplicity, only one of the 12 tone generating systems will be discussed, since the other systems are identical. Thus, the selected frequency number from storage 56 is sent to a frequency number accumulator 62. Accumulator 62 adds the selected frequency number to its cumulative total at a fixed clock rate (FCLK). When accumulator 62 overflows, an "overflow pulse" is sent to address generator 66, and accumulator 62 is reset to its initial value. Address generator 66 addresses successive sample points in the registration memories based on successive overflow pulses. In this manner, address generator 66 controls the frequency or pitch of the tone being sounded.

It can be seen that the rate at which a registration memory is addressed is entirely dependent on the frequency number selected, since the clock rate FCLK is constant. Thus, the note to be produced is identified in the first instance by keyboard encoder 48 which selects the appropriate frequency number from the frequency number ROM 54.

Having covered the general principles of operation of the parallel digital organ systems 12 and 14, it can now be seen how a mixture is produced. One or more mixture tabs 21 are provided on the organ. If more than one mixture tab is provided, the mixture tabs are selectively actuable to provide a mixture pattern only for selected keys on a particular keyboard. Thus, there may be a Great Mixture tab for the Great keyboard and a Swell Mixture tab for the Swell keyboard.

When the mixture tab is not activated, the key switch matrix 46 provides information to the keyboard encoders 48 of both organ systems 12 and 14, but the registration memories in the mixture organ system 14 are not enabled. Accordingly, no information is transmitted to the accumulators 42 and 44. However, when a mixture tab is activated, the registration memories of the mixture organ system 14 are enabled. If the organ has separate mixture tabs for each of the Great and Swell manuals, activation of one of these tabs creates a command which, when combined with the keyboard data signal from the keyboard decoder 60, allows information corresponding to that manual to be read out of the registration memories of the mixture organ system 14. A keyboard decoder 60 receives the count information of note, octave and keyboard counters 50 and produces a keyboard data signal indicative of the keyboard being scanned, i.e., Great, Swell or Pedal, as well as a keyboard region data signal indicative of the region being scanned within the keyboard. The regional data signal may be used to address either or both of ROMs 38, 40 to cause mixture wave forms corresponding to the active keyboard region to be read out of the appropriate frequency. A mixture wave form corresponding to each keyboard region would be stored in different locations in ROMs 38, 40 and would be addressed according to the keyboard data and keyboard region data signals.

The frequency number ROM 54 of the mixture organ system 14 contains frequency numbers which differ from but are related to the corresponding frequency numbers of the basic organ system 12 in the following manner. Suppose that a four rank mixture is desired with three "breaks" along the keyboard, giving rise to four keyboard regions. The resulting mixture pattern is shown in Tables 3 and 4:

TABLE 3

| Keyboard Region | Mixture Harmonic Series Relationship | | | |
|---|---|---|---|---|
| | Base Tone* | First Tone | Second Tone | Third Tone |
| $C_1$-$B_1$ | 1 | 8** | 12 | 16 |
| $C_2$-$B_2$ | 1 | 4 | 6 | 8 |
| $C_3$-$F\#_4$ | 1 | 2 | 3 | 4 |
| $G_4$-$C_6$ | 1 | 1 | 1.5 | 2 |

*depressed key i.e. appropriate note of principal chorus
**weighting factor to produce desired harmonic

TABLE 4

| Keyboard Region | Mixture Pitch Series Relationship | | | |
|---|---|---|---|---|
| | Base Tone | First Tone | Second Tone | Third Tone |
| $C_1$-$B_1$ | 8 ft. | 1 ft. | $\frac{2}{3}$ ft. | $\frac{1}{2}$ ft. |
| $C_2$-$B_2$ | 8 ft. | 2 ft. | $1\frac{1}{3}$ ft. | 1 ft. |
| $C_3$-$F\#_4$ | 8 ft. | 4 ft. | $2\frac{2}{3}$ ft. | 2 ft. |
| $G_4$-$C_6$ | 8 ft. | 8 ft. | $5\frac{1}{3}$ ft. | 4 ft. |

In practice, an organist might wish to combine the 8 ft. Diapason tone with a 4 ft., a $2\frac{2}{3}$ ft. and a 2 ft to achieve a Principal chorus, as shown for the third keyboard region in Table 4. This in turn will create additional mixture pitch series relationships for each of the other keyboard regions.

To accomplish the above mixture, frequency number ROM 54 of the mixture organ system 14 contains frequency numbers for the first keyboard region which are weighted by a factor of eight times the frequency numbers stored in the ROM 54 in basic organ 12 for the same keyboard region. For the second keyboard region, the ratio of the weighted keyboard numbers stored in organ 14 to the basic keyboard numbers stored in organ 12 is four to one. The ratio is two to one for the third keyboard section and one to one for the fourth or upper keyboard section. This relationship is shown in the following table:

TABLE 5

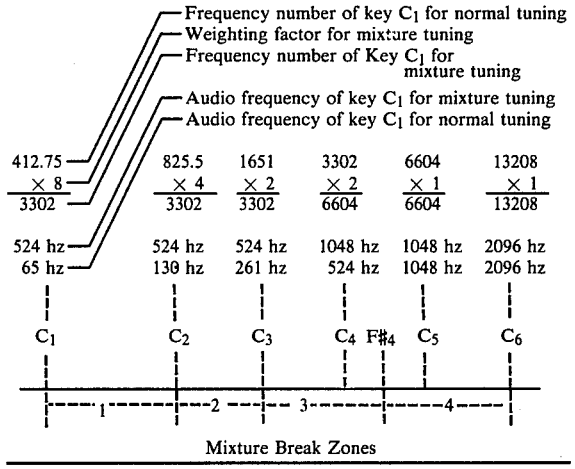

When a voice, such as the 8 ft. Diapason, is selected by activating one or more stop tabs from memories 26 and/or 28, the voice is written into respective ones of the registration memories 34 or 36 of both the basic organ 12 and the mixture organ 14 (assuming that a mixture tab has been operated). In the registration memory section of mixture organ system 14, ROM 38 contains the sample points of a complex mixture wave form which is a composite of a basic wave form, such as a diapason voice (commonly used for mixtures) and specific harmonics of that wave form necessary to produce an approximation of the tones in Table 3. Similarly, ROM 40 has sample points of a composite mixture wave form of the diapason voice and its associated harmonics. While it is preferred that ROM 38 contain odd harmonics and ROM 40 contain even harmonics using channels 45 and 47 for audio channel separation and greater quality sound reproduction, programming a single mixture ROM with the sample points of a single complex wave form would also be an acceptable method to reproduce the example mixture.

From the organist's viewpoint, the present invention operates as follows. Suppose the organist depresses a key in the first region of the keyboard with both a mixture tab and another voice or voices selected by the appropriate stop tabs. Assume the weighting of frequency numbers stored in the mixture organ frequency number memory as shown in Table 5 above. The basic organ 12 will play the selected voice (loaded into RAMs 34 and 36) in the conventional manner at the frequency corresponding to the depressed key, as previously described. The mixture organ 14, however, will play the selected voice (loaded in RAMS 34 or 36 of the mixture organ) at a frequency which is eight times higher, because the frequency numbers stored in the mixture organ frequency number memory for that keyboard region are weighted by a factor of eight. The mixture organ will also play the compound diapason wave form in ROM 38 at a frequency eight times higher than the basic frequency, and will play the compound diapason wave form in ROM 40 at the same eight times higher frequency. If the key selected were in the second keyboard region, the tones played by the mixture organ 14 would be produced at a frequency four times greater than the basic organ, and so on along the keyboard. Thus, organ systems 12 and 14 produce a composite mixture sound as shown in Tables 3 and 4.

When a mixture tab and another voice tab are selected producing the composite mixture sound described above, a tone enhancement occurs. The mixture organ system 14 sounds the three higher harmonic tones according to the weight factors in the above example. The selected voice read out of either RAM 34 or RAM 36 of organ system 14, depending on the voice tab operated, reinforces or enhances the base tone sounded in the same voice in the basic organ system 12 as described in Table 3. Differing tonal effects are available depending upon the voice tab selected. It should be noted that the frequency or pitch of the selected voice in organ system 14 will break back along the keyboard according to the weighted frequency numbers stored in memory 56.

It should also be noted that the weighting arrangement selected, that is, $\times 8$, $\times 4$, $\times 2$, $\times 1$ is merely cited as an example. Other weighting factors could be selected according to varying musical tastes.

The above description corresponds to the preferred embodiment of the invention in an electronic organ. However, it should be noted that the invention could be embodied in a simpler form. Suppose for instance that it were desired to provide only a mixture tone with "breaks" along the keyboard but without the enhancement previously described. Only the mixture organ 14 having the weighted frequency numbers in memory 54 would be required to sound. A single compound mixture wave form made of a voice and the desired mixture series harmonics would be sounded from organ system 14. Playing keys along the keyboard would then result in a mixture series which breaks back along the keyboard regions according to the corresponding sequence of weighted frequency numbers.

Additionally, another simple mixture could be provided by having two parallel organ systems such as 12 and 14, identical in every respect except for the weighted frequency numbers of the mixture organ system 14. In other words, mixture organ system 14 would not have ROMs 38 and 40. In that instance, a depressed key would cause organ system 12 to sound the desired voice at the frequency corresponding to the depressed key, and would cause organ system 14 to sound the voice in the higher harmonic determined by the weighted frequency number in the mixture organ frequency memory.

While these simple embodiments should be regarded as encompassed by the present invention, it is envisioned that a musician would prefer a true sounding mixture obtainable by the preferred embodiment described herein.

The present invention may be embodied in other specific forms without departing from the spirit or essential attributes thereof and, accordingly, reference should be made to the appended claims, rather than to the foregoing specification, as indicating the scope of the invention.

We claim:

1. Method for producing a mixture tone in a keyboard electronic musical instrument of the type wherein musical tones are produced by reading out of memory stored sample points of a complex wave form, the sample points being read from memory at a rate corresponding to a frequency number associated with an active key of the keyboard, comprising the steps of:

(a) providing a keyboard having a selected number of keyboard regions such that each region comprises two or more contiguous keys;

(b) weighting the frequency numbers associated with the respective keys by a preselected factor for each keyboard region, the factor for each successive region along the keyboard, proceeding from the lower end of the musical scale to the upper end, being the same as or lower than the factor for the immediately preceding region;

(c) storing in memory a complex mixture wave form which is a composite of two or more selected wave forms; and (d) reading out of memory said stored complex mixture wave form at a rate corresponding to the weighted frequency number associated with an active key.

2. The method as in claim 1 wherein the step of weighting the frequency numbers includes weighting the frequency numbers by factors which are multiples of two.

3. The method as in claim 1 wherein the step of storing in memory a complex mixture wave form includes selecting a complex mixture wave form which is a composite of two or more harmonically related wave forms.

4. A method as in any one of claims 1, 2 or 3 comprising the steps of:

(a) storing the weighted frequency numbers in a memory; and (b) addressing the memory to read out the weighted frequency number associated with the active key.

5. Method of producing a mixture tone in a keyboard electronic musical instrument of the type wherein musical tones are produced by reading out of memory stored sample points of a complex wave form, the sample points being read from memory at a rate corresponding to a frequency number associated with an active key of the keyboard, comprising the steps of:

(a) providing a keyboard having a selected number of keyboard regions such that each region comprises two or more contiguous keys;

(b) weighting the frequency numbers associated with the respective keys by a preselected factor for each keyboard region, the factor for each successive region along the keyboard, proceeding from the lower end of the musical scale to the upper end, being the same as or lower than the factor for the immediately preceding region;

(c) storing in a first memory a first mixture complex wave form which is a composite of two or more selected wave forms;

(d) storing in a second memory a second mixture complex wave form which is a composite of two or more selected wave forms;

(e) reading out of memory said first and second stored mixture complex wave forms at a rate corresponding to the weighted frequency number associated with an active key.

6. The method as in claim 5 wherein the step of storing in a first memory a first mixture complex wave form which is a composite of one or more selected wave forms includes selecting a complex mixture wave form which is a composite of two or more harmonically related wave forms, and the step of storing in a second memory a second mixture complex wave form which is a composite of one or more selected wave forms includes selecting a complex mixture wave form which is a composite of two or more harmonically related wave forms.

7. Method of producing a mixture tone in an electronic organ of the type wherein musical tones are produced by reading out of memory stored sample points of a complex wave form, the sample points being read from memory at a rate corresponding to a frequency number associated with an active key of the organ, comprising the steps of:

(a) providing an organ keyboard having a selected number of keyboard regions;

(b) providing two tone generating systems operatively connected in parallel to said keyboard;

(c) producing in a first of the two tone generating systems selected frequency numbers associated with the keys of said keyboard;

(d) producing in the second of the two tone generating systems weighted frequency numbers that are selected multiples of the frequency numbers associated with the same keys in the first tone generating system, the multiple being the same within a keyboard region but differing from keyboard region to keyboard region;

(e) storing sample points of a first complex wave form in a first memory in the first tone generating system;

(f) storing sample points of a second complex wave form in a second memory in the second tone generating system;

(g) reading out of said first memory said sample points at a rate corresponding to the selected frequency number associated with an active key;

(h) reading out of said second memory said sample points at a rate corresponding to the weighted frequency number associated with an active key.

8. Method according to claim 7 wherein the weighted frequency numbers produced in the second tone generating system are multiples of two of the selected frequency numbers produced in the first tone generating system.

9. In an electronic musical instrument of the type wherein musical tones are produced by reading out of memory stored sample points of a complex wave form, including a keyboard having plural keys corresponding to the notes of a musical scale, means for generating a frequency number representative of a note corresponding to an active key, and means for reading out the sample points from memory at a rate corresponding to the frequency number, apparatus for producing a mixture tone comprising:

(a) a keyboard having a selected number of keyboard regions such that each region comprises two or more contiguous keys;

(b) means for weighting the frequency numbers associated with the respective keys by a preselected multiple for each keyboard region, the multiple for each successive keyboard region, proceeding from the lower end of the musical scale to the upper end, being the same as or lower than the multiple for the immediately preceding region; and (c) means for storing sample points of a complex mixture wave form which is a composite of two or more selected wave forms; and (d) means for reading out said sample points at a rate corresponding to the weighted frequency number associated with the active key.

10. An electronic musical instrument as in claim 9 wherein the multiples for the keyboard regions are selected so that the multiple of each successive region is one-half the multiple of the immediately preceding region.

11. An electronic musical instrument as in either one of claims 9 or 10 comprising:

(a) said means for generating a frequency number and said means for weighting the frequency numbers comprises a memory in which weighted frequency numbers are stored; and (b) means for addressing said memory in accordance with the depressed key to read out the weighted frequency number associated with that key.

12. An electronic musical instrument as in claim 11 further comprising:

(a) one or more additional means for storing sample points of complex wave forms which may be composites of two or more selected wave forms; and (b) means for reading out said sample points from the additional storage means at a rate corresponding to the weighted frequency numbers.

13. An electronic musical instrument as in claim 9 wherein the selected wave forms are harmonically related.

14. In an electronic organ of the type wherein musical tones are produced by reading out of storage sample points of a complex wave form, including a keyboard having plural keys corresponding to the notes of a musical scale, means for generating a frequency number representative of a note corresponding to an active key of the keyboard, and means for reading out the stored sample points at a rate corresponding to the frequency number associated with an active key, apparatus for producing a mixture tone comprising:

(a) a keyboard having a selected number of keyboard regions;

(b) first and second organ systems operatively connected in parallel to said keyboard;

(c) the first organ system having means for generating unweighted frequency numbers each representative of a note corresponding to an active key;

(d) the second organ system having means for generating weighted frequency numbers each corresponding to an active key, each weighted frequency number being a selected multiple of the unweighted frequency number, said multiple being the same within a keyboard region but differing from one keyboard region to another, and the multiple for each successive keyboard region along the keyboard, proceeding from the lower end of the musical scale to the upper end, being the same as or lower than the multiple for the immediately preceding region;

(e) the first organ system having means for storing the sample points of a first complex wave form;

(f) the second organ system having means for storing the sample points of a second complex wave form which may be the same or different from the first complex wave form;

(g) means in the first organ system for reading out the stored sample points of the first complex wave form at a rate corresponding to the unweighted frequency numbers; and (h) means in the second organ system for reading out the stored sample points of the second complex wave form at a rate corresponding to the weighted frequency numbers.

15. Apparatus as in claim 14 wherein the selected multiples for successive keyboard regions are related by a factor of two.

16. Apparatus as in either of claims 14 or 15 wherein:

(a) said means for generating said unweighted frequency numbers includes means for storing said unweighted frequency numbers;

(b) said means for generating said weighted frequency numbers include means for storing said weighted frequency numbers;

(c) said means for reading out the sample points of the first complex wave form includes means for addressing the means for storing said unweighted frequency numbers in accordance with an active key to read out the frequency number associated with that key; and (d) said means for reading out the sample points of the second complex wave form includes means for addressing the means for storing said weighted frequency numbers in accordance with the active key to read out the weighted frequency number associated with that key.

17. Apparatus as in claim 16 further comprising:

(a) means in the second organ tone system for storing the sample points of a third complex wave form which is a composite of two or more selected wave forms; and (b) means for reading out the stored sample points of the third complex wave form at a rate corresponding to the weighted frequency numbers.

18. Apparatus as in claim 17 wherein the third complex wave form is a composite of two or more harmonically related wave forms.

19. An electronic organ as in claim 18 wherein the third complex wave form is composite of a diapason voice and one or more selected harmonics of the diapason voice.

20. Method of producing a mixture tone in a keyboard electronic musical instrument of the type wherein musical tones are produced by reading out of memory stored sample points of a complex wave form, the sample points being read from memory at a rate corresponding to a frequency number associated with an active key of the keyboard, comprising the steps of:

(a) providing a keyboard having a selected number of keyboard regions such that each region comprises two or more contiguous keys;

(b) weighting the frequency numbers associated with the respective keys of a preselected factor for each keyboard region, the factor for each successive region along the keyboard, proceeding from the lower end of the musical scale to the upper end, being the same as or lower than the factor for the immediately preceding region;

(c) storing in memory a voice wave form; and (d) reading out of memory said stored voice wave form at a rate corresponding to the weighted frequency number associated with an active key.

21. The method as in claim 20 wherein the step of weighting the frequency numbers includes weighting the frequency numbers by factors which are multiples of two.

22. The method as in claim 20 wherein the step of storing in memory a voice wave form includes selecting a voice wave form which is a composite of two or more harmonically related wave forms.

23. In an electronic musical instrument of the type wherein musical tones are produced by reading out of memory stored sample points of a complex wave form, including a keyboard having plural keys corresponding to the notes of a musical scale, means for generating a frequency number representative of a note corresponding to an active key, and means for reading out the sample points from memory at a rate corresponding to the frequency number, apparatus for producing a mixture tone, comprising:

(a) a keyboard having a selected number of keyboard regions such that each region comprises two or more contiguous keys;

(b) means for weighting the frequency numbers associated with the respective keys by a preselected multiple for each keyboard region, the multiple for each successive keyboard region, proceeding from the lower end of the musical scale to the upper end, being the same as or lower than the multiple for the immediately preceding region;

(c) means for storing sample points of a voice wave form; and (d) means for reading out said sample points at a rate corresponding to the weighted frequency number associated with the active key.

24. An electronic musical instrument as in claim 23 wherein the multiples for the keyboard regions are selected so that the multiple of each successive region is one-half the multiple of the immediately preceding region.

* * * * *